US009889656B2

(12) United States Patent
Katagiri et al.

(10) Patent No.: US 9,889,656 B2
(45) Date of Patent: Feb. 13, 2018

(54) CHANNEL SUBSTRATE, METHOD OF PRODUCING CHANNEL SUBSTRATE, LIQUID DISCHARGE HEAD, INK CARTRIDGE, AND LIQUID DISCHARGE APPARATUS

(71) Applicants: Daisuke Katagiri, Kanagawa (JP); Takashi Mori, Kanagawa (JP)

(72) Inventors: Daisuke Katagiri, Kanagawa (JP); Takashi Mori, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/238,798

(22) Filed: Aug. 17, 2016

(65) Prior Publication Data

US 2017/0066237 A1 Mar. 9, 2017

(30) Foreign Application Priority Data

Sep. 4, 2015 (JP) ..... 2015-174752
Jul. 8, 2016 (JP) ..... 2016-135758

(51) Int. Cl.

| | |
|---|---|
| ***B41J 2/175*** | (2006.01) |
| ***B41J 2/14*** | (2006.01) |
| ***B41J 2/16*** | (2006.01) |
| ***B41J 29/38*** | (2006.01) |

(52) U.S. Cl.

CPC ..... *B41J 2/1433* (2013.01); *B41J 2/1632* (2013.01); *B41J 2/17503* (2013.01); *B41J 2/17553* (2013.01); *B41J 29/38* (2013.01)

(58) Field of Classification Search

CPC ..... B41J 2/2114; B41J 2/211; B41J 2/0015; B41J 2/17553; B41J 2/14274; B41J 2/14233; B41J 2/1433; B41J 2/14201; B41J 2/14209; B41J 2/1632; B41J 2/1634

See application file for complete search history.

(56) References Cited

U.S. PATENT DOCUMENTS

| | | | | |
|---|---|---|---|---|
| 5,402,162 | A * | 3/1995 | Fusting | B41J 2/14209 347/43 |
| 6,214,245 | B1 * | 4/2001 | Hawkins | B41J 2/162 216/27 |
| 2006/0092237 | A1 * | 5/2006 | Kwon | B41J 2/14282 347/68 |
| 2007/0106962 | A1 | 5/2007 | Sakakibara et al. | |
| 2007/0115323 | A1 | 5/2007 | Mori | |
| 2007/0242107 | A1 | 10/2007 | Mori | |
| 2007/0247492 | A1 | 10/2007 | Mori | |
| 2008/0239004 | A1 * | 10/2008 | Iwanaga | B41J 2/14072 347/54 |
| 2009/0033704 | A1 | 2/2009 | Mori | |

(Continued)

FOREIGN PATENT DOCUMENTS

| | | |
|---|---|---|
| JP | 2002-113529 | 4/2002 |
| JP | 2003-165226 | 6/2003 |

(Continued)

*Primary Examiner* — Sharon A Polk

(74) *Attorney, Agent, or Firm* — Cooper & Dunham LLP

(57) ABSTRACT

A channel substrate includes a plurality of individual channels and a plurality of linear machining marks. The plurality of individual channels is arrayed in row. The plurality of linear machining marks is substantially parallel to a direction in which the plurality of individual channels is arrayed in row.

12 Claims, 10 Drawing Sheets

(56) References Cited

U.S. PATENT DOCUMENTS

| | | | | |
|---|---|---|---|---|
| 2010/0231631 | A1 | 9/2010 | Hosaka et al. | |
| 2014/0111579 | A1* | 4/2014 | Hirai | B41J 2/1433 347/42 |
| 2014/0375725 | A1 | 12/2014 | Sameshima et al. | |
| 2015/0110688 | A1* | 4/2015 | Igata | B01L 3/502707 422/502 |

FOREIGN PATENT DOCUMENTS

| | | | |
|---|---|---|---|
| JP | 2009-179032 | | 8/2009 |
| JP | 2011-016331 | | 1/2011 |
| JP | 2011016331 | A * | 1/2011 |

* cited by examiner

CHANNEL SUBSTRATE, METHOD OF PRODUCING CHANNEL SUBSTRATE, LIQUID DISCHARGE HEAD, INK CARTRIDGE, AND LIQUID DISCHARGE APPARATUS

CROSS-REFERENCE TO RELATED APPLICATIONS

This patent application is based on and claims priority pursuant to 35 U.S.C. §119(a) to Japanese Patent Application Nos. 2015-174752 filed on Sep. 4, 2015 and 2016-135758 filed on Jul. 8, 2016 in the Japan Patent Office, the entire disclosure of each of which is hereby incorporated by reference herein.

BACKGROUND

Technical Field

Aspects of the present disclosure relate to a channel substrate, a method of producing the channel substrate, a liquid discharge head, an ink cartridge, and a liquid discharge apparatus.

Related Art

A liquid discharge head (droplet discharge head) is known that includes a channel substrate in which individual channels are formed. For such a liquid discharge head, voltage is applied to a pressure generator, such as a piezoelectric element, to bend (expand and contract) the pressure generator. Accordingly, the volume of the pressurization chamber is changed to change the pressure in the pressurization chamber, thus discharging liquid, such as ink, a deoxyribonucleic acid (DNA) sample, and liquid resist. The individual channel includes, e.g., a nozzle orifice and a pressurization chamber (individual liquid chamber). In other words, the pressurization chamber constitutes part of the individual channels and the nozzle orifice constitutes part of the individual channel.

An image forming apparatus, such as a printer, a facsimile machine, a copier, a plotter, and a multifunction peripheral having at least two of the foregoing capabilities, may include a liquid discharge head to discharge recording liquid, e.g., ink. For example, a serial-type image forming apparatus includes a carriage mounting a recording head constituted of the liquid discharge head. The serial-type image forming apparatus causes the carriage to serially scan in a direction perpendicular to a direction of conveyance of a recording medium (hereinafter, simply referred to as "sheet") and intermittently feeds the sheet according to the width of recording. By repeating the recording and feeding operations, the serial-type image forming apparatus forms an image on the sheet. A line-type image forming apparatus is also known that includes a line-type recording head having an increased number of nozzles per head.

There is demand for higher speed and higher image quality in the field of such an image forming apparatus. In particular, for the line-type recording head, there is demand for increasing the length of the recording head to increase the number of nozzles per head and form a complex channel shape.

There is also demand for cost reduction while increasing the length of the recording head. As the material of the nozzle pate, a metal material or a resin material is widely used because of relative easiness of the adaptation to the increase of the head length.

SUMMARY

In an aspect of the present disclosure, there is provided a channel substrate that includes a plurality of individual channels and a plurality of linear machining marks. The individual channels are arrayed in a row. The linear machining marks are substantially parallel to a direction in which the plurality of individual channels is arrayed in the row.

In another aspect of the present disclosure, there is provided a liquid discharge head including the channel substrate, to discharge liquid.

In still another aspect of the present disclosure, there is provided an ink cartridge that includes the liquid discharge head and an ink tank to supply ink to the liquid discharge head.

In still yet another aspect of the present disclosure, there is provided a liquid discharge apparatus that includes the liquid discharge head to discharge liquid.

In still yet another aspect of the present disclosure, there is provided a method of producing a channel substrate constituting part of a plurality of individual channels arrayed in a row. The method includes pushing a working tool into the channel substrate from a first side of the channel substrate to form recessed portions at the first side and convex portions at a second side of the channel substrate opposite the first side, and grinding the convex portions with a grinding tool in a direction substantially parallel to a direction in which the convex portions are arrayed.

In still yet another aspect of the present disclosure, there is provided a method of producing a channel substrate constituting part of a plurality of individual channels arrayed in a row. The method includes pushing a working tool into from a first side of the channel substrate to faun through holes at the first side and at a second side of the channel substrate opposite the first side, and grinding both the first side and the second side of the channel substrate with a grinding tool in a direction substantially parallel to a direction in which the through holes are arrayed.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
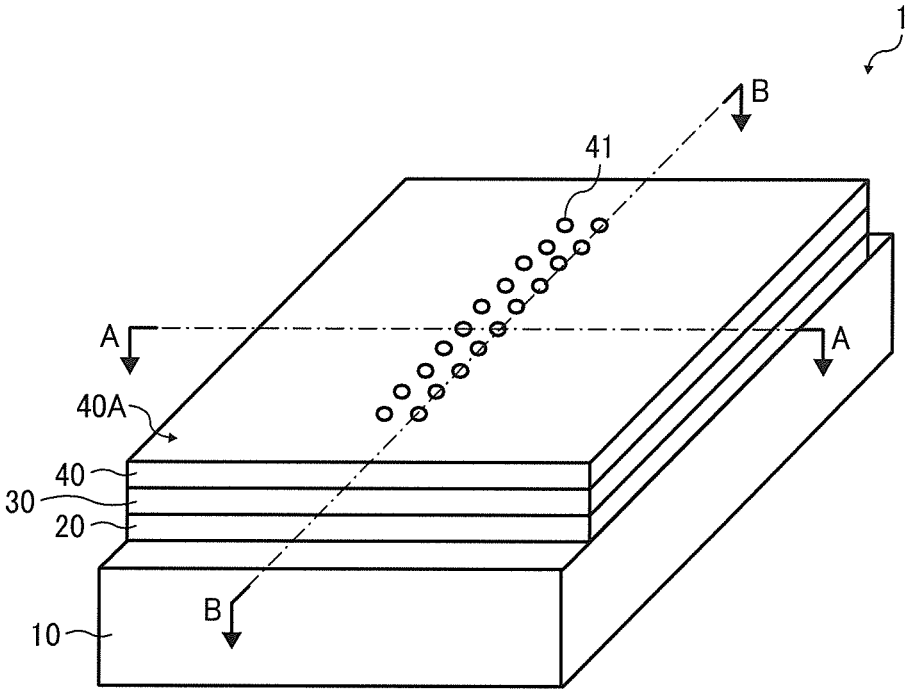
FIG. 1 is a perspective view of a liquid discharge head according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, an image forming apparatus according to some embodiments of the present disclosure is described below.

First, configurations of embodiments according to the present disclosure are described below with reference to FIGS. 1 to 15. A channel substrate according to an embodiment of the present disclosure includes channel formation members (e.g., a nozzle plate 40 and a channel plate 30) forming part of a plurality of individual channels (e.g., nozzle orifices 41 and pressurization chambers 31) arrayed in rows. Linear machining marks (e.g., linear machining marks 44 and linear machining marks 34) are formed substantially parallel to a direction in which the individual channels are arrayed.

First Embodiment

As a first embodiment of the present disclosure, an example is described in which linear machining marks are formed on a nozzle plate as the channel substrate.

Liquid Discharge Head

Figure 2:
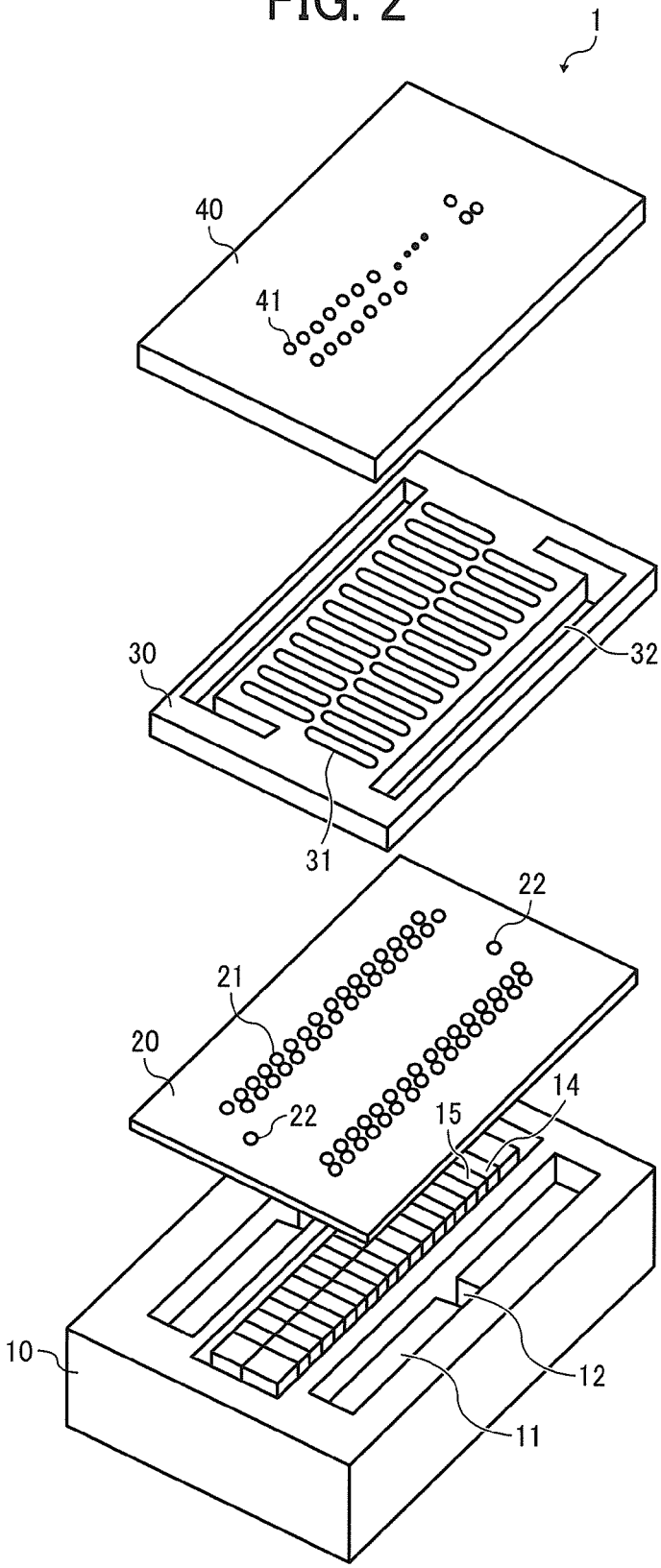
FIG. 2 is an exploded perspective view of the liquid discharge head illustrated in FIG. 1.
Figure 3:
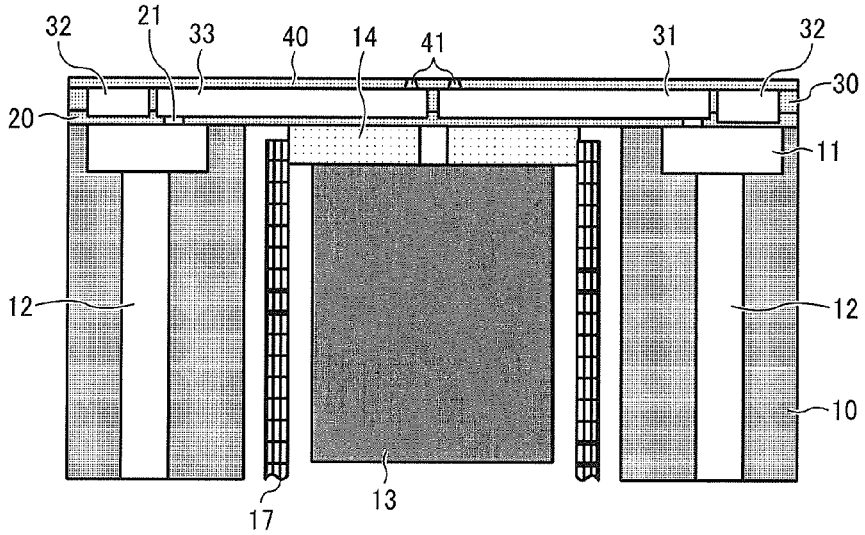
FIG. 3 is a cross-sectional view of the liquid discharge head cut along line A-A of FIG. 1.
Figure 4:
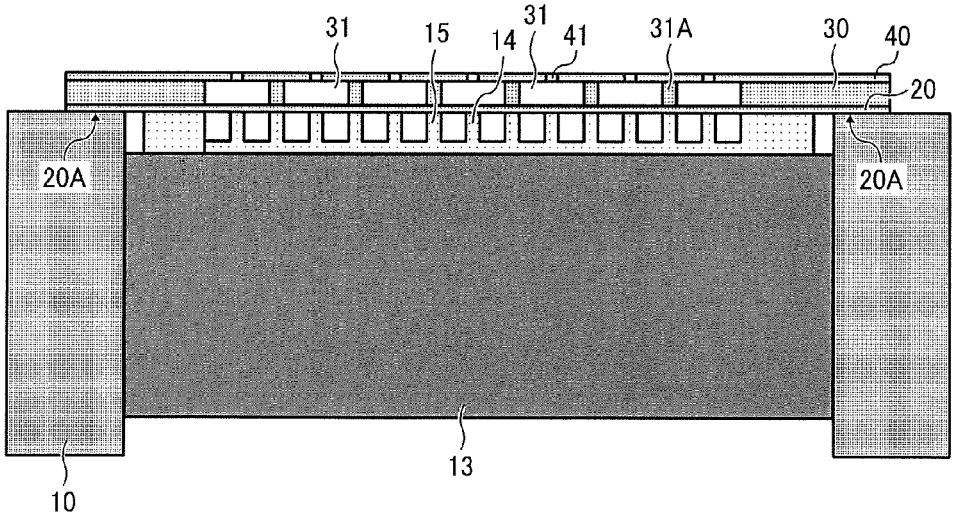
FIG. 4 is a cross-sectional view of the liquid discharge head cut along line B-B of FIG. 1.

FIG. 1 is a perspective view of a liquid discharge head according to the first embodiment of the present disclosure. FIG. 2 is an exploded perspective view of the liquid discharge head according to the first embodiment. FIG. 3 is a cross-sectional view of the liquid discharge head cut along line A-A of FIG. 1. FIG. 4 is a cross-sectional view of the liquid discharge head cut along line B-B of FIG. 1.

A liquid discharge head 1 according to the present embodiment includes a diaphragm 20, a channel plate 30 (a channel formation member including pressurization chambers 31), and a nozzle plate 40 (another channel formation member including nozzle orifices 41) that are bonded each other and laminated one on another in this order on a frame member 10.

The frame member 10 includes a base substrate 13, piezoelectric elements 14 (laminated piezoelectric elements or electromechanical transducer elements), common liquid chambers 11, and ink supply holes 12. The base substrate 13 is made of highly-rigid material, such as metal or ceramic. The piezoelectric elements 14 are pressure generators bonded to the base substrate 13, to pressurize liquid, e.g., ink, in the pressurization chambers 31 of the channel plate 30.

The frame member 10 is formed by injection molding, for example, epoxy resin or polyphenylene sulfide.

In each piezoelectric element 14, piezoelectric layers made of lead zirconate titanate (PZT), each having a thickness of from 10 μm to 50 μm per layer, and internal electrode layers made of silver-palladium (AgPd), each having a thickness of several um per layer, are alternately laminated one on another. Internal electrodes are electrically connected alternately to discrete electrodes and common electrodes, which are end-face electrodes (external electrodes) of end faces of the piezoelectric element 14 so that driving signals are supplied to the discrete electrodes and the common electrodes through a flexible printed circuit (FPC) cable 17.

The piezoelectric element 14 has one face bonded to the base substrate 13 and the other face bonded to the diaphragm 20.

When driving signals are applied to the piezoelectric element 14 and the piezoelectric element 14 is charged, the piezoelectric element 14 extends. When an electric charge of the piezoelectric element 14 is discharged, the piezoelectric element 14 contracts in a direction opposite an extending direction of the piezoelectric element 14. The extension and contraction of the piezoelectric element 14 bend the diaphragm 20, thus contracting and expanding the corresponding pressurization chamber 31.

Between the piezoelectric elements 14, pillars 15 are disposed corresponding to partitions 31A between the pressurization chambers 31. In the present embodiment, slitting is performed on a piezoelectric element substrate by half-cut dicing to divide the piezoelectric element substrate in a comb shape, thus forming the piezoelectric elements 14 and the pillars 15. The configuration of the pillar 15 is the same as the configuration of the piezoelectric element 14 and acts as a simple support since no drive voltage is applied to the pillar 15.

An outer periphery 20A of the diaphragm 20 is bonded to the frame member 10 via adhesive.

The diaphragm 20 includes ink supply ports 21 communicated with the pressurization chambers 31 to supply ink from the common liquid chambers 11 of the frame member 10 to the pressurization chambers 31.

The diaphragm 20 is, for example, a metal plate of nickel having a three-layer structure and is produced by, e.g., electroforming. In some embodiments, the diaphragm 20 may be other metal plate, a resin plate, a laminated member including a metal plate(s) and a resin plate(s), or a laminated member including a plurality of metal plates.

The channel plate 30 is produced by molding a stainless steel material in a plate shape, and includes the pressurization chambers 31, ink supply channels 33, and damper chambers 32. The pressurization chambers 31 and the ink supply channels 33 are formed by pressing. The damper chambers 32 are formed by wet etching and half etching to be shallower than the pressurization chambers 31. In some embodiments, the channel plate 30 may include the pressurization chambers 31 and other channel patterns formed by conducting anisotropic etching on a single-crystal silicon substrate of (110) crystal plane orientation using an alkaline etchant, such as potassium hydroxide solution (KOH). Note that the material of the channel plate 30 is not limited to such a single-crystal silicon.

The damper chambers 32 are rectangular spaces interposed between the nozzle plate 40 and the diaphragm 20, and are communicated with ambient air through an air communication conduits 22 of the diaphragm 20, thus achieving an air damper effect.

The nozzle plate 40 includes the nozzle orifices 41 corresponding to the pressurization chambers 31. Below, the nozzle plate 40 is further described.

Nozzle Plate

In the nozzle plate 40, the nozzle orifices 41 are formed by pressing and grinding.

The nozzle plate 40 is produced by forming a stainless steel (SUS) material in a plate shape. The nozzle plate 40 made of a metal material of SUS group is compatible with various types of liquid and a long shape and can reduce the material cost. Note that the material of the nozzle plate 40 is not limited to stainless steel and may be other metal material.

The inner shape of the nozzle orifice 41 is, for example, a straight shape, a tapered shape, or a combination of a straight shape and a tapered shape. The nozzle orifice 41 has a hole diameter of, for example, approximately 10 μm to approximately 35 μm at an exit side of ink droplet. The nozzle pitch in each nozzle row is, for example, 150 dpi.

A water-repellent layer surface-treated for water repellency is disposed on a nozzle face 40A (a liquid discharge face being an outer face in a direction of discharge of liquid) of the nozzle plate 40. The water-repellent layer is formed by a treatment selected in accordance with the physical properties of ink from, for example, polytetrafluoroethylene (PTFE)-Ni eutectoid plating, electrodeposition of fluororesin, vapor deposition of explorative fluororesin (e.g., fluorinated pitch), firing after coating of a solution of silicon-based resin or fluorine-based resin. The water-repellent layer can stabilize the shape and flying properties of ink droplet and create high-quality images.

Figure 5:
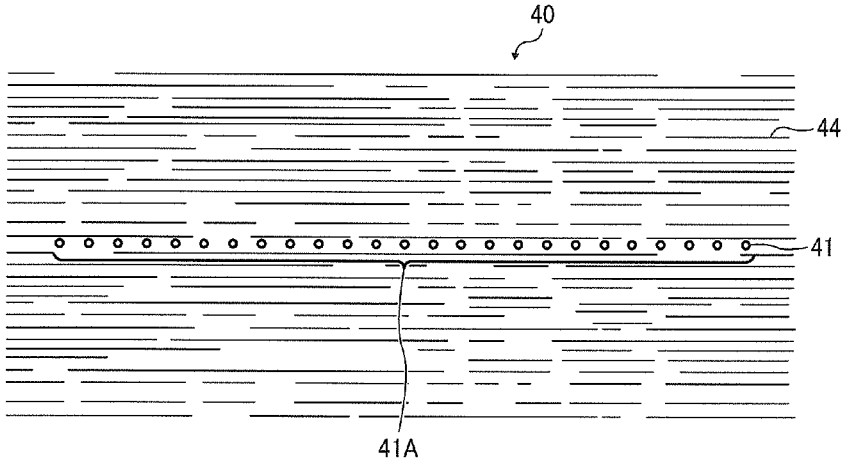
FIG. 5 is a schematic view of a nozzle plate in which a nozzle row is foamed.

FIG. 5 is a schematic view of the nozzle plate 40 (the nozzle face 40A) including a nozzle row 41A. The nozzle plate 40 includes the nozzle row 41A of the plurality of nozzle orifices 41. The nozzle plate 40 includes linear machining marks 44 parallel (or substantially parallel) to a direction (nozzle array direction) in which the nozzle row 41A is formed.

A method of producing the nozzle plate 40 illustrated in FIG. 5 is described with reference to FIGS. 6A, 6B, and 6C. The method of producing the nozzle plate 40 include a first step (pressing step) and a second step (grinding step). In the first step, a working tool (a punch 50) is pushed into nozzle-orifice formation positions of a metal plate from one side of the metal plate to form recessed portions (recessed portions 42) at the one side and convex portions (convex portions 43) at the other side. In the second step, the convex portions 43 are ground with a grinding tool (grinding tool 51) in a direction (indicated by arrow D1 in FIG. 6B) substantially parallel to a direction in which the convex portions 43 are arrayed.

Figure 6A:
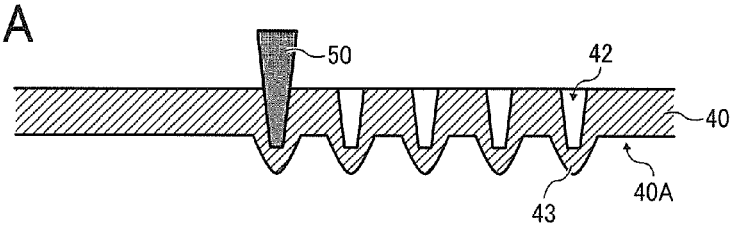
FIGS. 6A to 6C are illustrations of a process of producing nozzle orifices in the nozzle plate illustrated in FIG. 5.
Figure 6B:
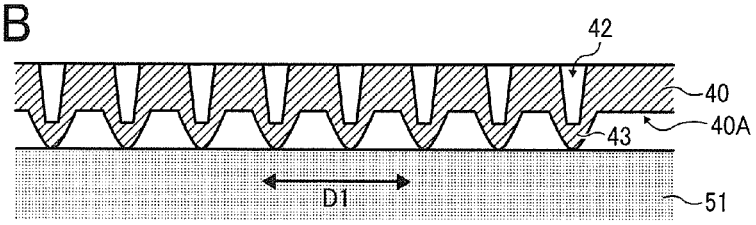
Figure 6C:
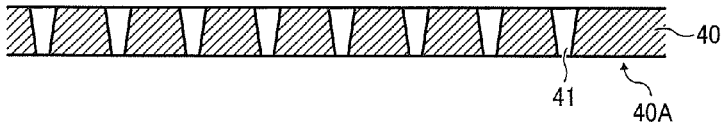

FIGS. 6A, 6B, and 6C are cross-sectional views of the nozzle plate 40 and illustrations of production steps of the nozzle orifices 41. As described below, the nozzle orifices 41 in the nozzle plate 40 are formed by the pressing step and the grinding step.

As illustrated in FIG. 6A, the nozzle plate 40 is deformed into the shape of the nozzle orifices 41 through plastic deformation by pressing in which the punch 50 is pushed into the nozzle-orifice formation positions of the nozzle plate 40 being a plate member made of metal material from one side of the nozzle plate 40 (the opposite side of the nozzle face 40A). Through the pressing, the recessed portions 42 are formed in the nozzle plate 40 and the convex portions 43 projecting from the nozzle face 40A are formed (the pressing step).

Next, as illustrated in FIG. 6B, the grinding step is performed to remove the convex portions 43 using the grinding tool 51. In the grinding, at least one of lapping grinding and polishing grinding is performed using the grinding tool 51. The machining direction of the grinding tool 51 (indicated by arrow D in FIG. 6B) is parallel (or substantially parallel) to the nozzle array direction.

Through the pressing step and the grinding step, the recessed portions 42 are formed and the convex portions 43 are removed. Thus, the recessed portions 42 are open toward the nozzle face 40A and, as illustrated in FIG. 6C, the nozzle orifices 41 are formed.

As described above, when the machining direction of the grinding tool 51 is parallel (or substantially parallel) to the nozzle array direction, as illustrated in FIG. 5, the linear machining marks 44 formed by grinding are parallel (or substantially parallel) to the nozzle row 41A.

Figure 7A:
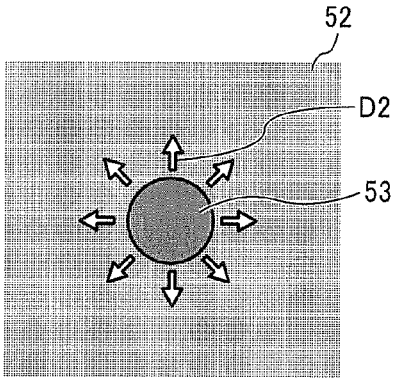
FIG. 7A is an illustration of an example of a round machining mark and reliefs.
Figure 7B:
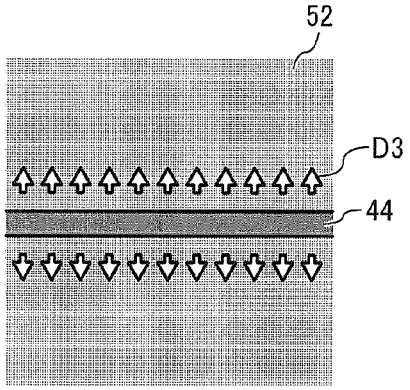
FIG. 7B is an illustration of an example of linear machining marks and reliefs.

FIGS. 7A and 7B are illustrations of reliefs. FIG. 7A is an illustration of an example of a round machining mark. FIG. 7B is an illustration of an example of linear machining marks. As illustrated in FIG. 7A, when a flat plate 52 is pressed using a punch of a column shape to form a round machining mark 53, as indicated by arrows in FIG. 7A, reliefs are generated in directions (all directions indicated by arrow D2 in FIG. 7A) vertical to a side face of the round machining mark 53.

By contrast, as illustrated in FIG. 7B, when the linear machining marks 44 are formed by grinding and cutting, reliefs are generated in directions perpendicular to the linear machining marks 44 as indicated by arrows D3 in FIG. 7B.

As described above, the direction of grinding is randomized to reduce, e.g., the influence of characteristics of the grinding tool. Grinding is performed on the nozzle plate 40 according to this embodiment so that the direction of the linear machining marks 44 is parallel to the nozzle array direction. The direction of relief in the grinding step is perpendicular to the nozzle array direction. In other words, the direction of relief is restricted so as not to cause a positional deviation in a direction in which nozzles are adjacent to each other. Such a configuration reduces a positional deviation in the direction in which nozzles are adjacent to each other, thus allowing the nozzle plate 40 to obtain a positional accuracy in the direction in which nozzles of the nozzle row 41A are adjacent to each other.

Note that the punch 50 and the grinding tool 51 are not limited to any specific tools and may be either known or new tools. For example, a lapping film or a grinding pad may be used as the grinding tool 51, and a grinding method in using, e.g., a surface grinder may be applicable.

In the example of FIGS. 6A to 6C, the shape of the interior (the recessed portion 42) of the nozzle orifice 41 is tapered. In some embodiments, the interior of the nozzle orifice 41 may have, e.g., a straight shape or a straight-and-tapered shape.

Figure 8:
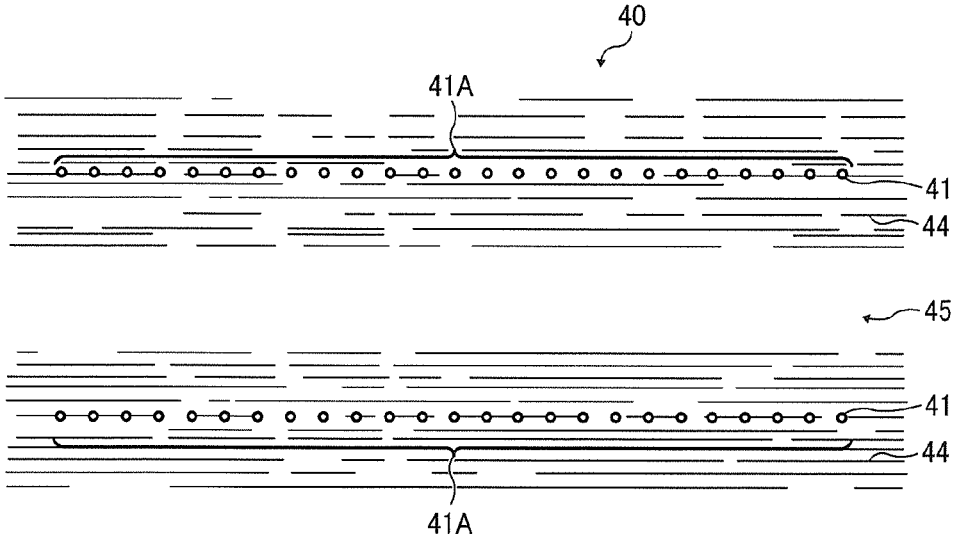
FIG. 8 is a schematic view of a nozzle plate in which an unmachined portion is disposed between nozzle rows.

FIG. 8 is a schematic view of the nozzle plate 40 (the nozzle face 40A) including the plurality of nozzle rows 41A. As illustrated in FIG. 8, when the plurality of nozzle rows 41A is formed in the nozzle plate 40, an unmachined portion 45 is preferably present between the plurality of nozzle rows 41A.

In the example of FIG. 8, the linear machining marks 44 are formed within a predetermined range from each of the two nozzle rows 41A in a direction perpendicular to each nozzle row 41A, and an intermediate portion between the linear machining marks 44 of the two nozzle rows 41A is the unmachined portion 45.

The unmachined portion 45 between the adjacent nozzle rows 41A reduces the amount of relief in a direction between the nozzle rows 41A. Such a configuration reduces the amount and variation of positional deviation of the nozzle orifices 41, thus enhancing the positional accuracy of the nozzle orifices 41.

Figure 9A:
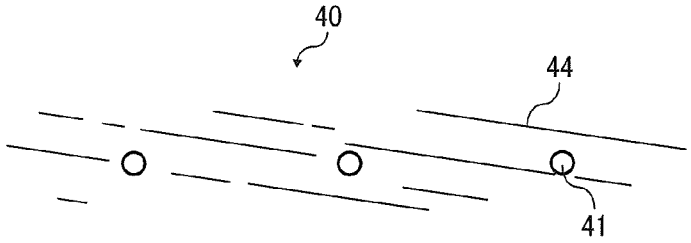
FIGS. 9A and 9B are illustrations of examples in which linear machining marks are substantially parallel to a nozzle array direction.

The linear machining marks 44 are formed parallel or substantially parallel to the nozzle array direction. FIG. 9A is an example in which the linear machining marks 44 are substantially parallel to the nozzle array direction. The linear machining marks 44 preferably have, for example, an angle of ±10° relative to the nozzle array direction.

Figure 9B:
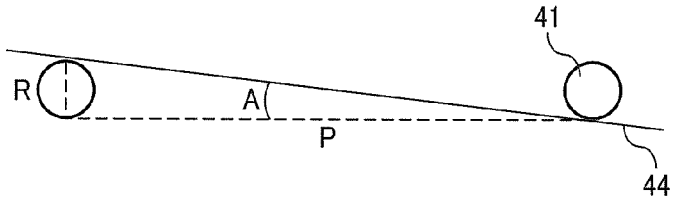

As illustrated in FIG. 9B, where R represents the diameter of the nozzle orifice 41, P represents the distance between the centers of adjacent nozzle orifices 41, and A represents the angle formed by the linear machining mark 44 and the nozzle row 41A, the following formula 1 is preferably satisfied: $\arctan(R/P)<A$ . . . (1).

Forming the linear machining marks 44 satisfying the above-described formula 1 can reduce incorporation of liquid from peripheral portions of nozzle orifices 41 into adjacent nozzle orifices 41 along grooves of the linear machining marks 44 during wiping.

Note that, when grinding is performed with an angle relative to the nozzle array direction, slight reliefs may occur in the nozzle array direction. However, since the angle is minute, the amount of relief is minute. Accordingly, the above-described configuration can achieve the effect of reducing the amount of positional deviation of nozzle orifices while obtaining the above-described effect.

The nozzle plate 40 according to the present embodiment described above can simplify the production process, reduce the production cost and the influence of reliefs in the grinding step, and obtain an excellent positional accuracy of nozzle orifices. The liquid discharge head 1 including the nozzle plate 40 can simplify the production process, reduce the production cost, and obtain an excellent discharging performance.

Second Embodiment

Next, the channel substrate according to another embodiment of the present disclosure is described below. Note that redundant descriptions of the same or similar components and configurations may be omitted below. In the second embodiment, a description is given of an example in which linear machining marks are formed in a channel plate as the channel substrate.

The channel plate 30 is produced by molding a metal material, such as a stainless steel material, in a plate shape, and includes the pressurization chambers 31, ink supply channels 33, and damper chambers 32. The pressurization chambers 31 and the ink supply channels 33 are formed by, e.g., pressing. The damper chambers 32 are formed by wet etching and half etching to be shallower than the pressurization chambers 31 (see FIGS. 2 to 4).

As the channel plate 30, a stainless steel material is preferably used in consideration of the compatibility with various types of liquid and the reduction of material cost. Note that the material of the channel plate 30 is not limited to such stainless steel material and may be a metal material.

Note that the nozzle plate 40 may be made of, for example, metal, such as stainless steel or nickel, or a combination of metal and resin, such as a polyimide resin film. The nozzle plate 40 is preferably formed with, for example, Ni plating film according to electroforming.

Channel Plate

Figure 10:
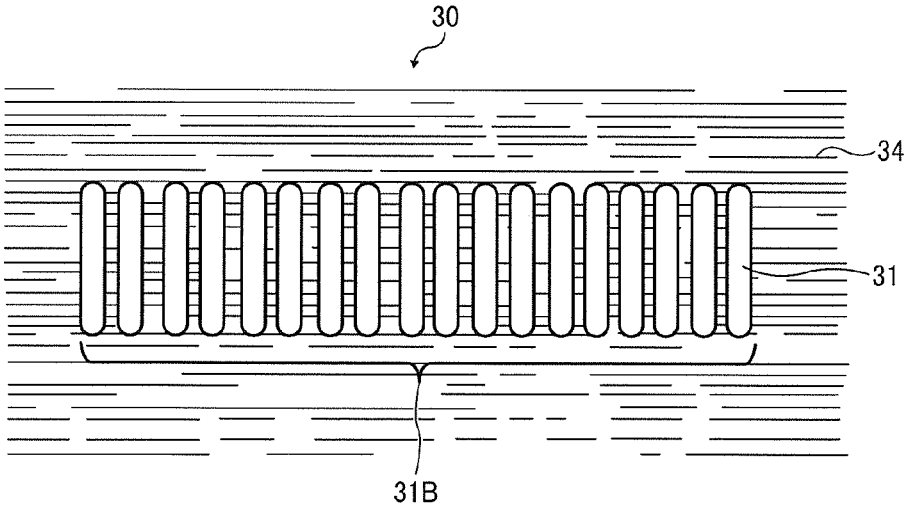
FIG. 10 is a schematic view of a channel plate in which pressurization chambers are formed.

The channel plate 30 is further described below. FIG. 10 is a schematic view of the channel plate 30 including the pressurization chambers 31.

The channel plate 30 includes linear machining marks 34 parallel (or substantially parallel) to a direction (pressurization-chamber-array direction) in which a pressurization chamber row 31B of the plurality of pressurization chambers 31 is formed.

Figure 11A:
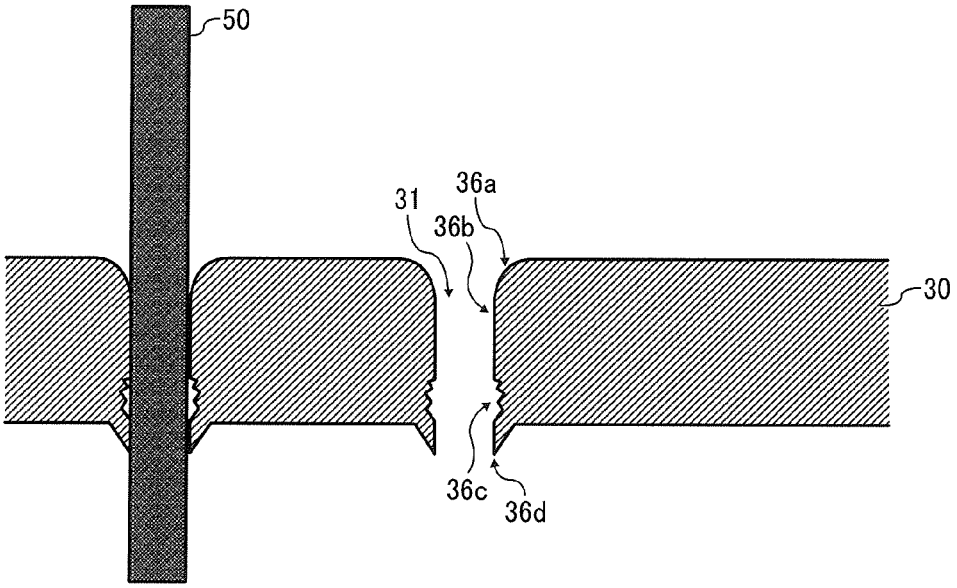
FIGS. 11A to 11C are illustrations of a process of producing pressurization chambers in the channel plate illustrated in FIG. 10.
Figure 11B:
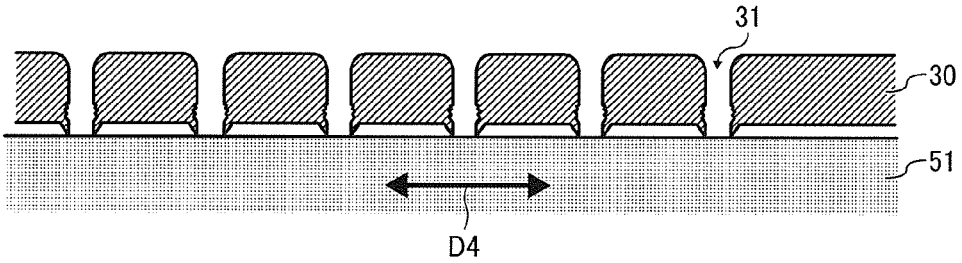
Figure 11C:
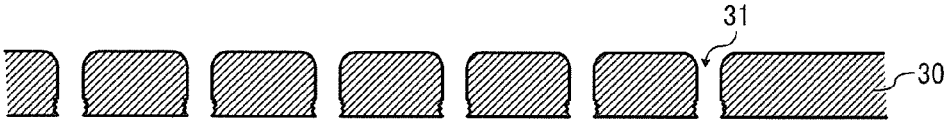

A description is given of a method of producing the channel plate 30 illustrated in FIG. 10. FIGS. 11A to 11C are cross-sectional views of the channel plate 30 and illustrations of production steps of the pressurization chambers 31. As described below, the pressurization chambers 31 in the channel plate 30 are formed by a pressing step and a grinding step.

First, as illustrated in FIG. 11A, the channel plate 30 is punched by pressing and shearing with the punch 50 at positions at which the pressurization chambers 31 are formed from one face of the channel plate 30 being a plate member made of a stainless steel material. When a punched side of the channel plate 30 is fractured, the punching is completed (the pressing step).

For the pressing to the plate member, such as stainless steel material, from shearing to fracturing, as illustrated in FIG. 11A, the pressurization chamber 31 has a round edge (R-portion 36*a*) at a punching side and a sheared portion 36*b*, a fractured portion 36*c*, and a burred portion 36*d*, which is formed by the punching.

Next, as illustrated in FIG. 11B, grinding is performed with the grinding tool 51 to remove the R-portions 36*a* and the burred portions 36*d*. In the grinding, at least one of lapping grinding and polishing grinding is performed on both faces of the channel plate 30 separately or simultaneously using the grinding tool 51 (see FIG. 11C). At this time, the machining direction of the grinding tool 51 (indicated by arrow D4 in FIG. 11B) is parallel (or substantially parallel) to the pressurization-chamber-array direction (the grinding step).

When the machining direction of the grinding tool 51 is parallel (or substantially parallel) to the pressurization-chamber-array direction, as illustrated in FIG. 10, the linear machining marks 34 formed by grinding are parallel (or substantially parallel) to the pressurization-chamber-array direction. Accordingly, similarly with the example illustrated in FIG. 7B, reliefs can be generated in the direction perpendicular to the linear machining mark 34.

As described above, the direction of grinding is randomized to reduce, e.g., the influence of characteristics of the grinding tool. Grinding is performed on the channel plate 30 according to the present embodiment so that the direction of the linear machining mark 34 is parallel to the pressurization-chamber-array direction. The direction of relief in the grinding step is perpendicular to the pressurization-chamber-array direction. In other words, the direction of relief is restricted so as not to cause a positional deviation between adjacent pressurization chambers 31, thus allowing the channel plate 30 to secure a positional accuracy between adjacent pressurization chambers 31.

Figure 12:
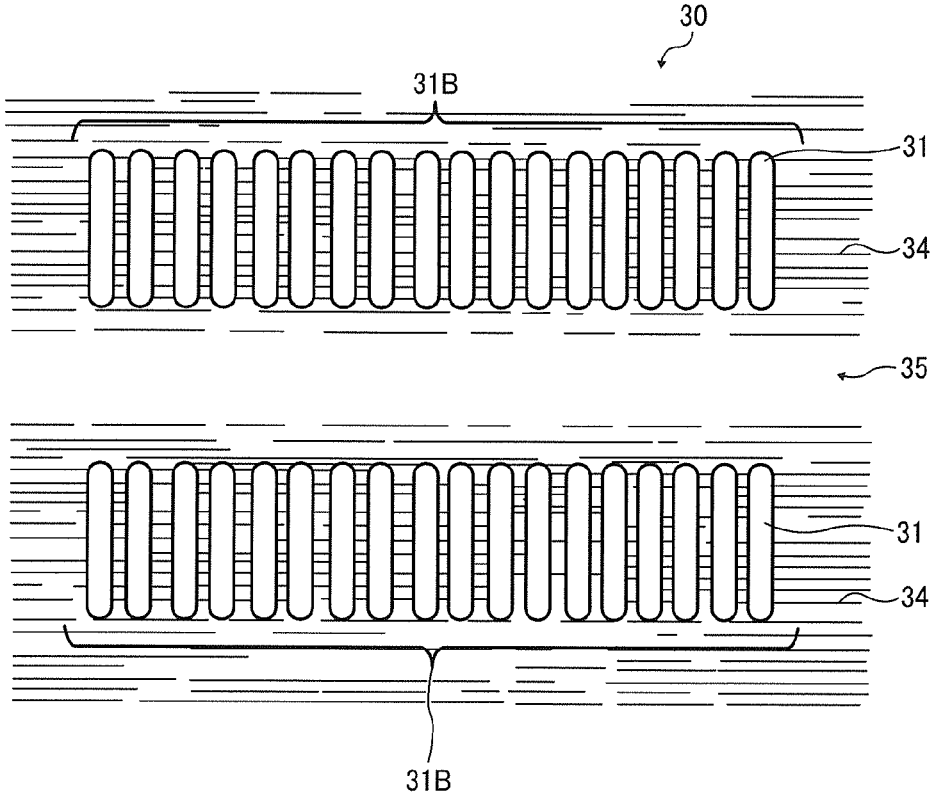
FIG. 12 is a schematic view of a channel plate in which an unmachined portion is disposed between a plurality of pressurization chambers.

FIG. 12 is a schematic view of the channel plate 30 including the plurality of pressurization chamber rows 31B. As illustrated in FIG. 12, when the plurality of pressurization chamber rows 31B is formed in the channel plate 30, an unmachined portion 35 is preferably present between the plurality of pressurization chamber rows 31B.

In the example of FIG. 12, the linear machining marks 34 are formed within a predetermined range from each of the two pressurization chamber rows 31B in a direction perpendicular to each pressurization chamber row 31B, and an intermediate portion between the linear machining marks 34 of the two pressurization chamber rows 31B is the unmachined portion 35.

The unmachined portion 35 between the adjacent pressurization chamber rows 31B reduces the amount of relief in a direction between the pressurization chamber rows 31B. Such a configuration reduces the amount and variation of positional deviation of the pressurization chambers 31, thus enhancing the positional accuracy of the pressurization chambers 31.

The channel plate 30 according to the present embodiment described above can simplify the production process, reduce the production cost and the influence of reliefs in the grinding step, and obtain an excellent positional accuracy of the pressurization chambers 31. The liquid discharge head 1 including the channel plate 30 can simplify the production process, reduce the production cost, and obtain an excellent discharging performance.

The channel substrate (the nozzle plate 40) in the first embodiment and the channel substrate (the channel plate 30) according to the second embodiment contribute to the enhancement of the positional accuracy of individual channels in the direction in which the individual channels are arrayed. When the liquid discharge head 1 includes both the nozzle plate 40 according to the first embodiment and the channel plate 30 according to the second embodiment, the positional accuracy of individual channel in the direction in which the individual channels are arrayed can be further enhanced.

Ink Cartridge

Next, a description is given of an ink cartridge including the liquid discharge head 1 according to the present embodiment.

Figure 13:
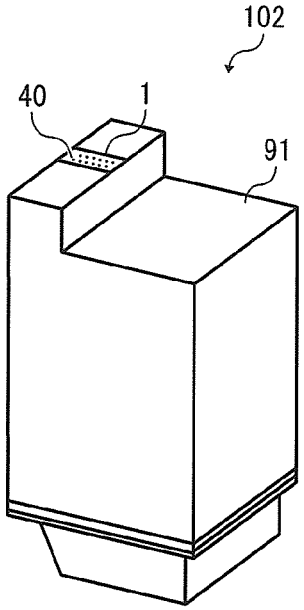
FIG. 13 is a perspective view of a configuration example of an ink cartridge including the liquid discharge head according to an embodiment of the present disclosure.

FIG. 13 is a perspective view of a configuration example of an ink cartridge including the liquid discharge head 1. An ink cartridge 102 includes the liquid discharge head 1 (inkjet head) and an ink tank 91 integrated as a single unit. The liquid discharge head 1 includes, e.g., the above-described nozzle plate 40. The ink tank 91 supplies ink to the liquid discharge head 1.

When the liquid discharge head 1 and the ink tank 91 are integrated as a single unit, cost reduction and performance enhancement of the liquid discharge head 1 directly lead to cost reduction and performance enhancement of the entire ink cartridge 102. Accordingly, reducing the cost and enhancing the performance of the liquid discharge head 1 allows the cost reduction and performance enhancement of the ink cartridge 102 of the head-integrated type.

Image Forming Apparatus

Next, an inkjet recording apparatus as an image forming apparatus including the liquid discharge head 1 according to the present embodiment is described below.

Figure 14:
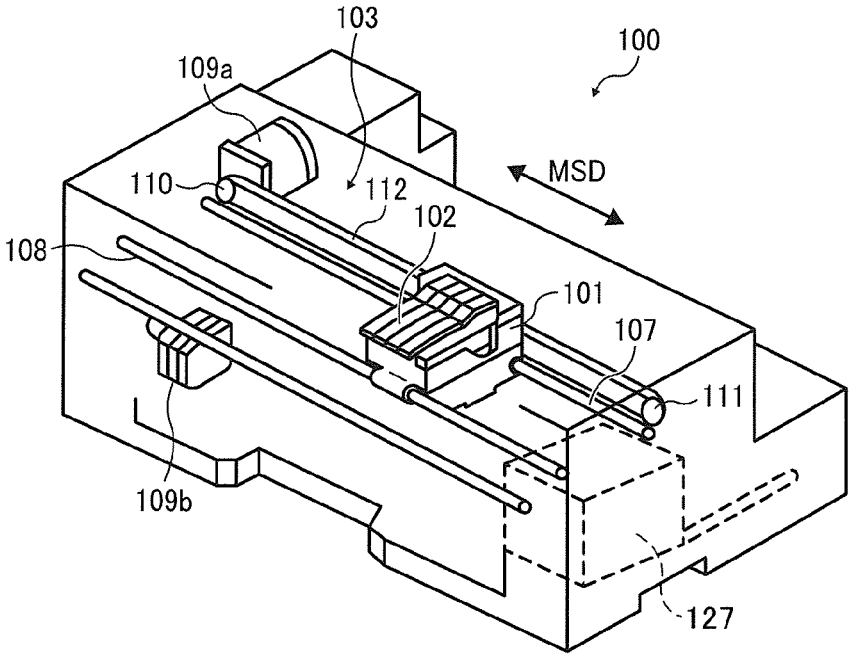
FIG. 14 is a perspective view of a configuration example of an inkjet recording apparatus including the liquid discharge head according to an embodiment of the present disclosure.
Figure 15:
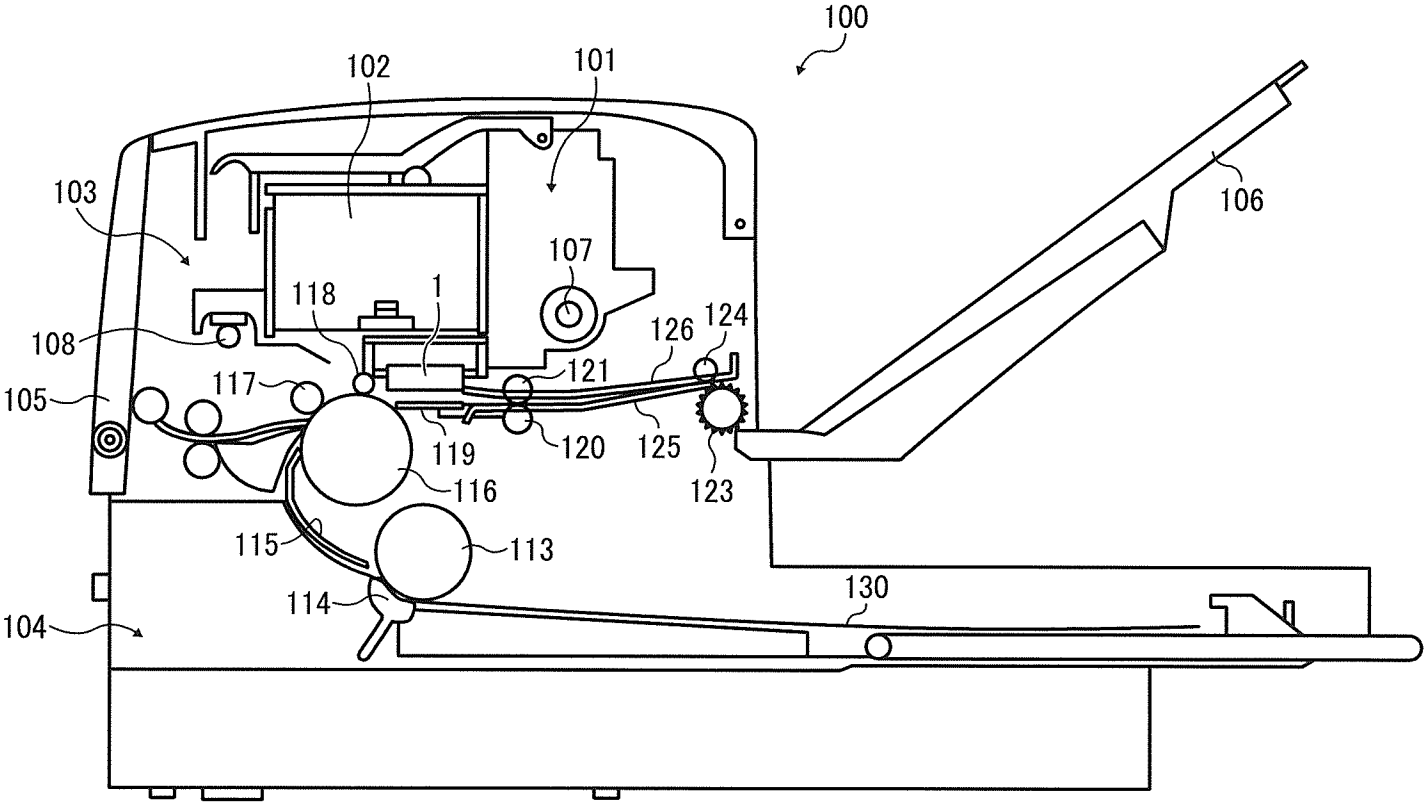
FIG. 15 is a side view of a configuration example of a mechanical section of an inkjet recording apparatus including the liquid discharge head according to an embodiment of the present disclosure.

FIG. 14 is a perspective view of a configuration example of the inkjet recording apparatus including the liquid discharge head. FIG. 15 is a side view of a configuration example of a mechanical section of the inkjet recording apparatus.

In an inkjet recording apparatus 100, a printing assembly 103 is stored in an apparatus body and a sheet feeding tray (sheet feeding cassette) 104 that can load multiple recording sheets 130 from the front side is removably mounted on a lower portion of the apparatus body. In addition, the inkjet recording apparatus 100 has a bypass tray 105 openable to manually feed the recording sheet 130. When the recording sheet 130 fed from the sheet feeding tray 104 or the bypass tray 105 is conveyed to the printing assembly 103, the printing assembly 103 records a desired image onto the recording sheet 130. The recording sheet 130 is ejected to an ejection tray 106 mounted on the rear side of the apparatus body.

The printing assembly 103 includes a carriage 101, the liquid discharge head 1, and the ink cartridge 102. The carriage 101 is movable in a main scanning direction indicated by arrow MSD in FIG. 14. The liquid discharge head 1 is mounted on the carriage 101. The ink cartridge 102 supplies ink to the liquid discharge head 1. In addition, the printing assembly 103 holds the carriage 101 with a main guide rod 107 and a sub-guide rod 108 so that the carriage 101 is slidable in the main scanning direction MSD. The main guide rod 107 and the sub-guide rod 108 are guides laterally bridged between left and right side plates. The liquid discharge heads 1 to discharge ink droplets of respective colors of yellow (Y), cyan (C), magenta (M), and black (Bk) are mounted on the carriage 101 so that a plurality of ink discharge ports (nozzles) of each nozzle row is arranged in a direction crossing the main scanning direction MSD. The liquid discharge heads 1 are mounted on the carriage 101 in such a direction that ink droplets are discharged downward. The ink cartridges 102 to supply the respective color inks to the liquid discharge heads 1 are mounted on the carriage 101 in a replaceable manner.

The ink cartridge 102 has an air port communicated with the ambient atmosphere at an upper side of the ink cartridge 102 and has a supply port to supply ink to the corresponding liquid discharge head 1 at a lower side of the ink cartridge 102. The ink cartridge 102 includes a porous material filled with ink. The ink to be supplied to the liquid discharge head 1 by capillary force of the porous material is maintained in slight negative pressure. In the present embodiment, the liquid discharge heads 1 discharge ink of respective colors. Note that, in some embodiments, a single liquid discharge head may be used that includes nozzles to discharge ink of different colors.

Here, the rear side of the carriage 101 (the downstream side of the carriage 101 in a direction (sheet conveyance direction) in which the recording sheet 130 is conveyed) is slidably fit into the main guide rod 107. The front side the carriage 101 (the upstream side of the carriage 101 in the sheet conveyance direction) is slidably placed on the sub-guide rod 108. In addition, a timing belt 112 is stretched taut between a driving pulley 110, which is driven to rotate by a main scanning motor 109*a*, and a driven pulley 111 to move the carriage 101 for scanning in the main scanning direction MSD. The timing belt 112 is secured on the carriage 101. Accordingly, the carriage 101 is reciprocatingly driven by forward and reverse rotation of the main scanning motor 109*a*.

The inkjet recording apparatus 100 includes a sheet feed roller 113, a friction pad 114, and a guide 115 to convey the recording sheet 130, which is set on the sheet feeding tray 104, to below the liquid discharge heads 1. The sheet feed roller 113 and the friction pad 114 separate and feed the recording sheets 130 sheet by sheet from the sheet feeding tray 104, and the guide 115 guides the recording sheets 130. The inkjet recording apparatus 100 further includes a conveyance roller 116, a conveyance roller 117, and a leading end roller 118. The conveyance roller 116 reverses and conveys the fed recording sheets 130. The conveyance roller 117 is pressed against an outer circumferential surface of the conveyance roller 116. The leading end roller 118 defines a feeding angle of the recording sheet 130 from the conveyance roller 116. The conveyance roller 116 is driven to rotate by a sub-scanning motor 109*b* via a gear train.

The inkjet recording apparatus 100 further includes a print receiver 119 as a sheet guide to guide the recording sheet 130, which is fed from the conveyance roller 116, below the liquid discharge heads 1 within a range corresponding to a movement range of the carriage 101 in the main scanning direction MSD. The inkjet recording apparatus 100 includes a conveyance roller 120 and a spur roller 121 on the downstream side of the print receiver 119 in the sheet conveyance direction. The conveyance roller 120 and the spur roller 121 are driven to rotate to feed the recording sheet 130 in a sheet ejection direction in which the recording sheet 130 is ejected. The inkjet recording apparatus 100 further includes an ejection roller 123 and a spur roller 124 to feed the recording sheet 130 to the ejection tray 106 and guides 125 and 126 forming a sheet ejection pathway through which the recording sheet 130 is ejected.

In recording, the inkjet recording apparatus 100 drives the liquid discharge heads 1 in accordance with image signals while moving the carriage 101, to discharge ink onto the stopped recording sheet 130 to record one line of a desired image. Then, the recording sheet 130 is fed by a certain distance, and another line is recorded. When a recording end signal or a signal indicating that a rear end of the recording sheet 130 arrives at a recording area is received, a recording operation is terminated and the recording sheet 130 is ejected.

The inkjet recording apparatus 100 further includes a recovery device 127 to recover a discharge failure of the liquid discharge heads 1, which is disposed at a position outside a recording area at the right end side in a movement direction of the carriage 101. The recovery device 127 has a capping unit, a suction unit, and a cleaning unit. In printing standby state, the carriage 101 is placed at the side in which the recovery device 127 is disposed and the liquid discharge heads 1 are capped with the capping unit. Accordingly, the ink discharge ports are maintained in a wet state, thus preventing occurrence of a discharge failure due to ink dry. For example, during recording, the inkjet recording apparatus 100 discharges ink not relating to the recording to maintain the viscosity of ink in all of the ink discharge ports constant, thus maintaining stable discharging performance.

When a discharge failure occurs, the ink discharge ports (nozzles) of the liquid discharge heads 1 are sealed with the capping unit and ink and bubbles are sucked from the ink discharge ports by the suction unit through a tube. Accordingly, ink and dusts adhered to a discharge port face (nozzle face) are removed by the cleaning unit, thus recovering the discharge failure. The sucked ink is drained to a waste ink container disposed on a lower portion of the apparatus body, and is absorbed into and retained in an ink absorber of the waste ink container. As described above, the inkjet recording apparatus 100 according to the present embodiment includes the recovery device 127. Such a configuration can recover a discharge failure of the liquid discharge heads 1, obtain a stable ink-droplet discharge property, and enhance image qualities.

As described above, the inkjet recording apparatus 100 as image forming apparatus according to the present embodiment includes the liquid discharge head 1 according to the present embodiment. That is, the inkjet recording apparatus 100 includes the liquid discharge head 1 of a relatively low cost and an excellent discharge performance.

Note that the above-described embodiments are examples of embodiments of the claimed invention, and the embodiments of the claimed invention are not limited to the above-described embodiments. The above-described embodiments can be variously modified within the scope of the claimed invention.

In the above-described embodiments, the inkjet printer is described as an example of the image forming apparatus. Note that the image forming apparatus may be an inkjet copier, an inkjet facsimile machine, or a multifunctional peripheral including at least two of the foregoing capabilities. The term "image forming apparatus", unless specified, also includes both serial-type image forming apparatus and line-type image forming apparatus.

The term "liquid discharge head" used herein is a functional component to discharge or jet liquid from nozzles. The pressure generator of the liquid discharge head is not limited to a particular-type of pressure generator. The pressure generator is not limited to the piezoelectric actuator (or a layered-type piezoelectric element) described in the above-described embodiments, and may be, for example, a thermal actuator that employs a thermoelectric conversion element, such as a thermal resistor or an electrostatic actuator including a diaphragm and opposed electrodes.

The term "image formation" means not only recording, but also printing, image printing, molding, and the like.

The term "liquid discharge device" is an integrated unit including the liquid discharge head and other functional parts, or the liquid discharge head and other structures, and denotes an assembly of parts relating to the liquid discharge function. For example, the liquid discharge device may be formed of a combination of a liquid discharge head with at least one of a head tank, a carriage, a supply assembly, a maintenance-and-recovery assembly, and a main scan moving assembly.

Herein, examples of the integrated unit include a combination in which the liquid discharge head and a functional part(s) are combined fixedly to each other through, e.g., fastening, bonding, or engaging, and a combination in which one of the liquid discharge head and a functional part(s) is movably held by another. In addition, the liquid discharge head can be detachably attached to the functional parts or structures each other.

For example, the liquid discharge head and a head tank are integrated as the liquid discharge device. The liquid discharge head and the head tank may be connected each other via, e.g., a tube to integrally form the liquid discharge device. Here, a unit including a filter may further be added to a portion between the head tank and the liquid discharge head, thereby forming another liquid discharge device.

In another example, the liquid discharge device may include a liquid discharge head integrated with a carriage as a single unit.

In still another example, the liquid discharge device includes the liquid discharge head movably held by a guide that forms part of a main-scanning moving device, so that the liquid discharge head and the main-scanning moving device are integrated as a single unit. The liquid discharge device may include the liquid discharge head, the carriage, and the main scan moving unit that are integrated as a single unit.

Furthermore, in another example, the cap that forms part of the recovery device is secured to the carriage mounted with the liquid discharge head so that the liquid discharge head, the carriage, and the recovery device are integrated as a single unit to form the liquid discharge device.

Further, in another example, the liquid discharge device includes tubes connected to the head tank or the channel member mounted on the liquid discharge head so that the liquid discharge head and the supply assembly are integrated as a single unit. Liquid is supplied from a liquid reservoir source to the liquid discharge head.

The main-scanning moving device may include only a guide. The supply assembly may include only a tube(s) or a loading unit.

The term "liquid discharge apparatus" used herein is an apparatus including the liquid discharge head or the liquid discharge device to discharge liquid by driving the liquid discharge head. As the liquid discharge apparatus, there are an apparatus capable of discharging liquid to a material on which liquid can be adhered as well as an apparatus to discharge liquid toward gas or liquid.

The liquid discharge apparatus may include devices to feed, convey, and eject the material on which liquid can be adhered. The liquid discharge apparatus may further include a pretreatment apparatus to coat a treatment liquid onto the material, and a post-treatment apparatus to coat a treatment liquid onto the material, onto which the liquid has been discharged.

Examples of the liquid discharge apparatus include an image forming apparatus to form an image on a sheet by discharging ink, and a three-dimensional apparatus to discharge a molding liquid to a powder layer in which powder material is formed in layers, so as to form a three-dimensional article.

In addition, the liquid discharge apparatus is not limited to such an apparatus to form and visualize meaningful images, such as letters or figures, with discharged liquid. For example, the liquid discharge apparatus may be an apparatus to form meaningless images, such as patterns, or fabricate three-dimensional objects.

The above-described term "material on which liquid can be adhered" represents a material on which liquid is at least temporarily adhered, a material on which liquid is adhered and fixed, or a material into which liquid is adhered to permeate. Examples of the "material on which liquid can be adhered" include recording media, such as paper sheet, recording paper, recording sheet of paper, film, and cloth, electronic component, such as electronic substrate and piezoelectric element, and media, such as powder layer, organ model, and testing cell. The "material on which liquid can be adhered" includes any material on which liquid is adhered, unless particularly limited.

Examples of the material on which liquid can be adhered include any materials on which liquid can be adhered even temporarily, such as paper, thread, fiber, fabric, leather, metal, plastic, glass, wood, and ceramic.

The "liquid" is not limited to a particular liquid as long as the liquid has a viscosity or surface tension to be discharged from a head. However, preferably, the viscosity of the liquid is not greater than 30 mPa·s under ordinary temperature and ordinary pressure or by heating or cooling. Examples of the liquid include a solution, a suspension, or an emulsion including, for example, a solvent, such as water or an organic solvent, a colorant, such as dye or pigment, a functional material, such as a polymerizable compound, a resin, a surfactant, a biocompatible material, such as DNA, amino acid, protein, or calcium, and an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

The liquid discharge apparatus may be an apparatus to relatively move a liquid discharge head and a material on which liquid can be adhered. However, the liquid discharge apparatus is not limited to such an apparatus. For example, the liquid discharge apparatus may be a serial head apparatus that moves the liquid discharge head or a line head apparatus that does not move the liquid discharge head.

Examples of the liquid discharge apparatus further include a treatment liquid coating apparatus to discharge a treatment liquid to a sheet to coat the treatment liquid on the surface of the sheet to reform the sheet surface and an injection granulation apparatus in which a composition liquid including raw materials dispersed in a solution is injected through nozzles to granulate fine particles of the raw materials.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A channel substrate comprising:

a plurality of individual channels arrayed in a row extending in an array direction; and a plurality of linear machining marks, each of the plurality of linear machining marks being arranged along a linear direction substantially parallel to the array direction in which the plurality of individual channels are arrayed in the row.

2. The channel substrate according to claim 1, further comprising a plurality of nozzle orifices constituting part of the plurality of individual channels.

3. The channel substrate according to claim 1, further comprising a plurality of pressurization chambers constituting part of the plurality of individual channels.

4. The channel substrate according to claim 1, further comprising an unmachined portion between a plurality of rows, each of the plurality of rows including the plurality of individual channels arrayed in the row.

5. A liquid discharge head comprising the channel substrate according to claim 1 to discharge liquid.

6. An ink cartridge comprising:

the liquid discharge head according to claim 5; and an ink tank to supply ink to the liquid discharge head.

7. A liquid discharge apparatus comprising the liquid discharge head according to claim 5 to discharge liquid.

8. The channel substrate according to claim 1, wherein at least one linear machining mark amongst the plurality of linear machining marks is longer than a width of each of the individual channels in the direction in which the plurality of individual channels is arrayed in the row.

9. The channel substrate according to claim 1, wherein each linear machining mark is longer than a width of each of the individual channels in the direction in which the plurality of individual channels is arrayed in the row.

10. The channel substrate according to claim 1, wherein the linear machining mark spans at least one individual channel amongst the plurality of individual channels in the direction in which the plurality of individual channels is arrayed in the row.

11. A method of producing a channel substrate constituting part of a plurality of individual channels arrayed in a row extending in an array direction, the method comprising:

pushing a working tool into the channel substrate from a first side of the channel substrate to form recessed portions at the first side and convex portions at a second side of the channel substrate opposite the first side; and grinding the convex portions with a grinding tool in a direction substantially parallel to a direction in which the convex portions are arrayed to form a plurality of linear machining marks, each of the plurality of linear machining marks being arranged along a linear direction substantially parallel to the array direction in which the plurality of individual channels are arrayed in the row.

12. A method of producing a channel substrate constituting part of a plurality of individual channels arrayed in a row extending in an array direction, the method comprising:

pushing a working tool into a first side of the channel substrate to form through holes at the first side and at a second side of the channel substrate opposite the first side; and grinding both the first side and the second side of the channel substrate with a grinding tool in a direction substantially parallel to a direction in which the through holes are arrayed to form a plurality of linear machining marks, each of the plurality of linear machining marks being arranged along a linear direction substantially parallel to the array direction in which the plurality of individual channels are arrayed in the row.

* * * * *